United States Patent [19]

Bregstein et al.

[11] 4,067,068

[45] Jan. 10, 1978

[54] PANTY

[76] Inventors: Henry Bregstein; Holly Bregstein, both of 1500 Palisade Ave., Fort Lee, N.J. 07024

[21] Appl. No.: 712,463

[22] Filed: Aug. 9, 1976

[51] Int. Cl.[2] ..... A41B 9/04

[52] U.S. Cl. ..... 2/406

[58] Field of Search ..... 2/406, 400

[56] References Cited

U.S. PATENT DOCUMENTS

| | | | |
|---|---|---|---|
| 2,748,772 | 6/1956 | Titone et al. | 2/406 |
| 3,237,625 | 3/1966 | Johnson | 2/406 |

*Primary Examiner*—Doris L. Troutman

*Attorney, Agent, or Firm*—Posnack, Roberts & Cohen

[57] ABSTRACT

The crotch area of the panty of the invention is made up of three layers: a first or outer layer, a second or inner layer, and a third or middle layer. The first and second layers are made of a porous, non-absorbent material, while the third or middle layer is made of a porous material, such as cotton, wool, or felted fabric. The first and second layers are preferably made of Nylon of about 15 denier. The first outer layer may be printed for decorative effect with a design corresponding to that of the rest of the panty.

9 Claims, 3 Drawing Figures

PANTY

FIELD OF THE INVENTION

This invention relates to garments and more particularly to panties and the like.

BACKGROUND OF THE INVENTION

Panty constructions are well known, and typically consist of a lower-torso portion including two leg openings separated by a crotch portion which may be monolithic with the balance of the garment or may be a separate portion sewn thereto.

More recently, the material from which panties are made is synthetic and is specifically nonabsorbent and non-retentive of fluid. This means that fluid discharged from the body may pass rapidly to outer garments or remains on the public region of the body, both of these possibilities having a variety of undesirable consequences.

Even where absorbent, fluid retaining materials are employed such as cotton, fluid is retained in juxtaposition to the pubic areas thereby developing unsanitary infectious conditions which it is desirable to overcome.

These problems have, moreover, come into sharper focus with the advent of recent innovations and styles such as panty hose, pant suits and so forth.

SUMMARY OF THE INVENTION

It is a primary object of the present invention to provide a panty construction which offers the highest degree of comfort along with the possibility of greater sanitary conditions.

It is a further object of the invention to provide an improved panty construction which feels and stays drier.

Yet another object of the invention is to provide an improved panty construction which facilitates and promotes evaporation.

Still another object is to reduce incidence of infection by minimizing moisture contact with the public areas.

Another object of the invention is to achieve the advantages thereof with no esthetic sacrifice.

In achieving the above and other objects of the invention, there is provided a panty construction made up of a conventional waist band section, a pair of leg band sections defining openings and a crotch area. The crotch area is comprised of three layers: a first or outer layer, a second or inner layer, and a third or middle layer. The first and second layers are made of a porous, non-absorbent material such as 15 denier nylon, while the third or middle layer is made of an absorbent material, such as a woven cotton or wood material, or a felted fabric. Moisture or fluid emanating from the body of the wearer of the panty of the present invention escapes through the porous non-absorbent and non-retentive inner layer and is absorbed by said middle layer of absorbent material, so that increased comfort and a more sanitary condition are provided. The porous non-absorbent and non-retentive outer layer of material allows for relatively rapid evaporation of the moisture held in the middle layer, this increases the comfort of the wearer of the panty of the present invention and optimizes sanitary conditions.

BRIEF DESCRIPTION OF THE DRAWING

The invention will be more readily understood with reference to the following detailed description, taken in conjunction with the accompanying drawing, wherein.

DETAILED DESCRIPTION OF THE INVENTION

Figure 1:
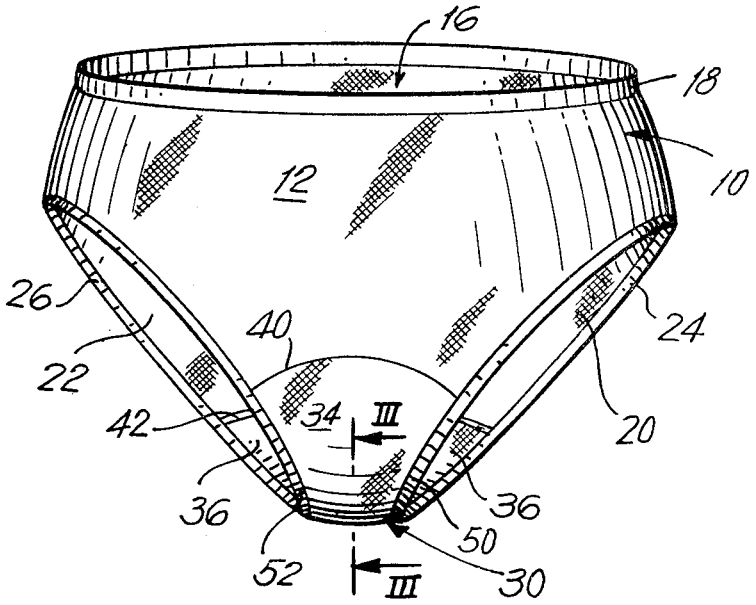
FIG. 1 is a front plan view showing the panty of the present invention with the improved crotch area attached to the main body portion of the panty.
Figure 2:
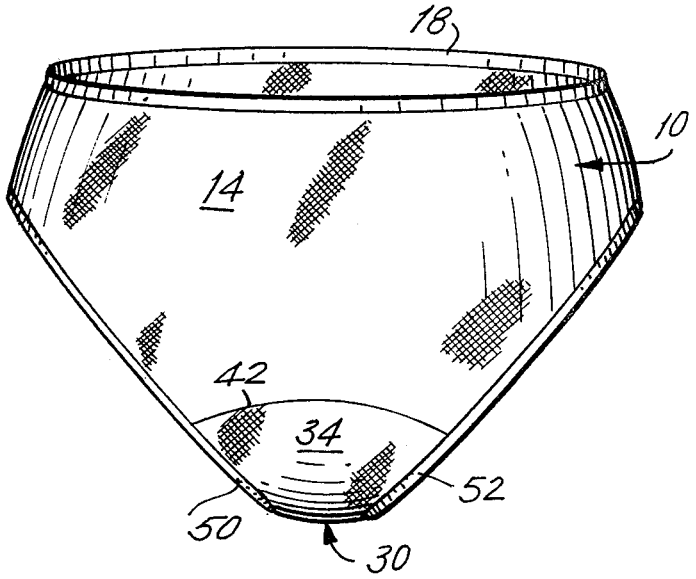
FIG. 2 is a rear plan view showing the panty and improved crotch area of FIG. 1.

In FIGS. 1 and 2, the panty of the present invention is shown as being made up of a main body portion referred to generally by reference character 10. The main body portion 10 has a front portion 12, a rear portion 14 and an opening 16 which is reinforced by an elastic waist band 18 so as to fit snugly about the waist of the wearer.

The main body portion 10 also defines a pair of leg openings 20 and 22 which are reinforced by elastic leg bands 24 and 26, respectively. These openings are separated by a crotch area 30 the construction of which is a feature of the present invention.

Figure 3:
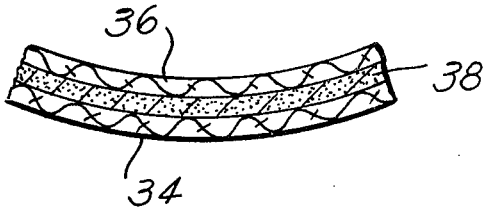
FIG. 3 is a cross-sectional view on enlarged scale along line 111—111 of FIG. 1.

The crotch area 30 is preferably made of three generally parallel layers of fabric, as can best be seen in diagrammatic form in FIG. 3. The first or outer layer 34 and the second inner layer 36 are both made of a porous non-absorbent and non-retentive material, such as Nylon, although it is to be understood that other fabrics having similar properties may be used.

By the terms "non-absorbent" and "non-retentive" reference is made to fluids and/or moisture emanating from openings in the body. The first and second layers sandwich therebetween a third or middle layer 38 made of an absorbent material, such as woven cotton or wool, or a felted fabric of the same or other absorbent materials. Preferably, this middle layer is not made of a synthetic material in order that a maximum absorbing capacity be achieved and in order to absorb the greatest amount of fluid or moisture emanating from the body of the wearer. No known synthetic materials have sufficient absorbing capacity.

In the preferred form of the invention, the first and second layers 34, 36 are made of Nylon of about 15 denier with an optimum weight of between seventeen and nineteen square yards per pound of fiber, and with a count of about ninety fibers per inch.

The third or middle layer is preferably made of 33 singles yarn cotton, having an optimum weight of between 4.15 and 5 square yards per pound of fiber. It is preferable that a shrink-controlled finish be applied to the Nylon fabric.

The main body portion 10 is preferably made of the same material as the outer layers, but is is to be understood that other material may be used. Specifically, one embodiment of the invention is contemplated in which body portion 10 and said outer layer are of different materials. Further, the outer layer and the fabric constituting the main body portion may be identically printed for esthetic purposes.

Because the crotch area 30 of the present invention is made of three layers, it is usually not possible to form the crotch area 30 integral with the main body portion 10. As can be seen in FIGS. 1 and 2, first stitchings 40 connect one end of the crotch area 30 to the front portion 12 of the main body portion 10, while second stitchings 42 connect the other end of the crotch area to the rear portion 14 of the main body portion 10. Of course, the crotch area is also stitched to leg bands 24 and 26 as indicated by characters 50, 52 in FIGS. 1 and 2.

The improved crotch area 30 of the present invention allows for a greater degree of comfort as well as a more sanitary condition since fluid and moisture emanating from the wearer's body is allowed to pass through the porous inner layer 36 directly to the absorbent middle layer 38, where the moisture is absorbed and retained. The outer layer 34, also being porous and non-absorbent, allows for venting of the moisture and fluid in the middle layer 38 to the outside atmosphere, in order to promote evaporation of the moisture and fluid. Thus the fluid and moisture are absorbed and prevented from staining the wearer's outerwear, while at the same time provision is made for greater comfort, since the inner layer contacting the wearer is dry. Infection is also prevented by keeping the moisture away from direct contact with the body of the wearer.

While a specific embodiment of the invention has been shown and described, it is to be understood that numerous changes and modifications may be made without departing from the scope and spirit of the invention. For example, the inner layer of the crotch area may be made of any monofilament Nylon or polyester yarn that is characteristically non-bulky, non-crimped, and of low weight.

What is claimed is:

1. A panty comprising a body portion, a waist band section on said body portion, a pair of leg band sections on said body portion defining leg openings, and a crotch area between the leg openings and connected to said body portion, said crotch area comprising an inner layer and a further layer outside of said inner layer, said inner layer being of a porous, non-absorbent and non-retentive material, and said further layer being of a moisture and fluid absorbing material, whereby moisture and fluid are absorbed by said further layer said crotch including an outer layer outside of said further layer, said outer layer being of a porous non-retentive material.

2. A panty according to claim 1, wherein said middle layer is of cotton.

3. A panty according to claim 1, wherein said middle layer is of wool.

4. A panty according to claim 1, wherein said middle layer is made of a felted fabric.

5. A panty according to claim 1, wherein said inner layer and outer layers are of Nylon.

6. A panty according to claim 1, wherein said body portion includes a front portion, said crotch area having a first end stitched to said front portion and a second end stitched to said rear portion.

7. A panty according to claim 5, wherein said outer layer is a printed fabric, and said body portion is of the same printed fabric.

8. A panty according to claim 1, wherein said inner and outer layers are of Nylon of about 15 denier having a weight range of between 17 and 19 square yards per pound of fiber.

9. A panty according to claim 7, wherein said middle layer is of 33 singles yarn cotton having an optimum weight range between 4.15 and 5 square yards per pound of fiber.

* * * * *